US010343125B2

(12) United States Patent
Räss et al.

(10) Patent No.: US 10,343,125 B2
(45) Date of Patent: Jul. 9, 2019

(54) PADDLE, PADDLE RAIL, MIXER SHAFT FOR A MIXER, MIXER AND METHOD FOR MIXING

(71) Applicant: BÜHLER AG, Uzwil (CH)

(72) Inventors: Roger Räss, Eggersriet (CH); Andrea Hermsmeyer, Oberuzwil (CH); Sebastian Wels, Oberbüren (CH)

(73) Assignee: BÜHLER AG, Uzwil (CH)

( * ) Notice: Subject to any disclaimer, the term of this patent is extended or adjusted under 35 U.S.C. 154(b) by 755 days.

(21) Appl. No.: 14/784,801

(22) PCT Filed: Apr. 17, 2014

(86) PCT No.: PCT/EP2014/057936
§ 371 (c)(1),
(2) Date: Dec. 4, 2015

(87) PCT Pub. No.: WO2014/170450
PCT Pub. Date: Oct. 23, 2014

(65) Prior Publication Data

US 2016/0166997 A1 Jun. 16, 2016

(30) Foreign Application Priority Data

Apr. 17, 2013 (EP) ..... 13164024

(51) Int. Cl.

| | |
|---|---|
| ***B01F 7/00*** | (2006.01) |
| ***B01F 7/04*** | (2006.01) |
| ***B01F 15/02*** | (2006.01) |
| *B01F 15/00* | (2006.01) |

(52) U.S. Cl.
CPC ..... *B01F 7/0025* (2013.01); *B01F 7/003* (2013.01); *B01F 7/00208* (2013.01); *B01F 7/00291* (2013.01); *B01F 7/00708* (2013.01); *B01F 7/04* (2013.01); *B01F 15/027* (2013.01); *B01F 2015/00642* (2013.01)

(58) Field of Classification Search
CPC ..... B01F 7/0025; B01F 7/00208; B01F 7/00291; B01F 7/003; B01F 7/00708; B01F 7/04; B01F 15/027
See application file for complete search history.

(56) References Cited

U.S. PATENT DOCUMENTS 5,580,170 A 12/1996 Holley et al.
7,195,440 B2 * 3/2007 Lambert ..... A01F 25/18 414/320

FOREIGN PATENT DOCUMENTS

| | | |
|---|---|---|
| EP | 1 990 085 B1 | 5/2008 |
| EP | 2 206 549 A1 | 7/2010 |
| JP | 2002143666 | 5/2002 |
| JP | 2004129519 | 4/2004 |
| WO | 2012/116883 A1 | 9/2012 |

* cited by examiner

*Primary Examiner* — Anshu Bhatia
(74) *Attorney, Agent, or Firm* — Davis & Bujold PLLC; Michael J. Bujold

(57) ABSTRACT

A paddle (30), a paddle rail (20), a mixer shaft (10) for a mixer (1), a mixer (1) and a method for mixing a product to be conditioned in a mixer (1). As the mixer (1) starts up, a product to be mixed is retained in a starting region of the mixer shaft (10), for instance, until the desired mixing or conditioning is achieved, so that loss-free start-up is made possible. That is to say disposal or recycling of the product when the mixer starts up becomes unnecessary.

12 Claims, 9 Drawing Sheets

PADDLE, PADDLE RAIL, MIXER SHAFT FOR A MIXER, MIXER AND METHOD FOR MIXING

Figure 1A:
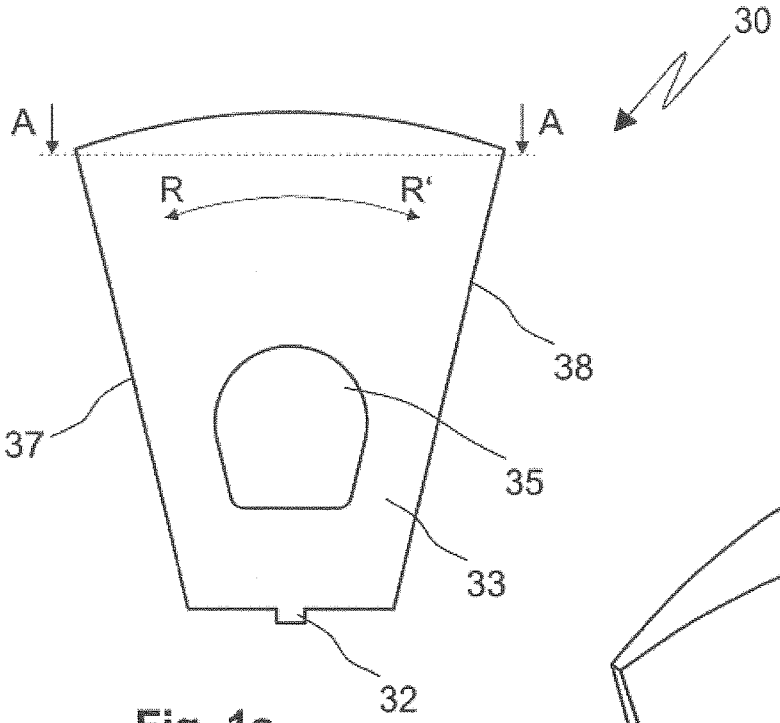

The present invention relates to a paddle, to a paddle rail and to a mixer shaft of a mixer, to a mixer and to a method for mixing as per the preambles of the independent claims.

Various mixers, which are used in particular in the processing of animal feed, are known from the prior art.

By way of example, EP 1 990 085 B1 discloses a mixer which consists essentially of a cylindrical housing and has an inlet at one end and an outlet at the other end. A mixer shaft having a multiplicity of paddles for mixing the product introduced into the mixer is arranged in the cylindrical housing. In order to prevent inadequate mixing or conditioning with, for example, steam primarily during start-up of the mixer, in an initial phase of operation the mixer shaft is operated with the outlet closed in such a manner that the material to be mixed accumulates in the region of the closed outlet. As soon as the dynamic pressure which builds up exceeds a certain value, the mixer shaft is operated in the opposite direction, such that the material to be mixed is once again mixed, conditioned and conveyed in the direction toward the inlet. As soon as a certain dynamic pressure is then reached again at the entry region, the mixer shaft is again driven in the direction of transport and the outlet is opened.

A method of this type is problematic in as much as the increased dynamic pressure cannot ensure that ail of the material is uniformly mixed and conditioned. Moreover, the mixer and the material to be mixed are undesirably subjected to pressure.

Other mixers known from the prior art are simply started, with the product initially being inadequately mixed and/or conditioned. The quantity of product required until the desired process conditions or properties are reached is in these cases conventionally disposed of or recycled.

It is an object of the invention to overcome the disadvantages of the prior art. In particular, the intention is to provide a paddle, a paddle rail, a mixer shaft and a mixer and also a method for mixing which allow for start-up without losses, i.e. the disposal or recycling of the product during start-up of the mixer becomes unnecessary.

This object is achieved by the methods and apparatuses defined in the independent patent claims. Further embodiments become apparent from the dependent patent claims.

Here and hereinbelow, the term "mixer" is understood to mean both a mixer for mixing different materials and a conditioner.

A paddle according to the invention for a mixer comprises a planar element which has a working face and a back face. During intended use, the paddle is arranged substantially on a plane perpendicular to an axis of rotation of a mixer shaft. The paddle has a fastening means for fastening the paddle on the mixer shaft. The working face is inclined by a working angle on one side and the back face is inclined by a back angle on the other side of the plane perpendicular to the axis of rotation of the mixer shaft. In this case, the back angle is smaller than the working angle. Since the back angle of the back face is smaller than the working angle of the working face, it is ensured that, during rotation of the paddle or of the mixer shaft in the direction of the tapering working and back face, a material to be mixed is not only mixed by the paddle but is also conveyed away from the working face further toward an outlet. The inclination of the working face in relation to the back face allows the paddle to have a cutting edge, on its front edge in the direction of rotation, which can be moved with little force through the material to be mixed.

Alternatively, the back angle of the back face can be the same as the working angle of the working face. This is advantageous in particular if an orientation of the paddle is adjustable, such that the back angle and working angle are variable.

It goes without saying that the working face and/or the back face can also be embodied as a curved face. The corresponding working angle and back angle are then considered to be an angle between the perpendicular plane and an imaginary line through the end points of the corresponding face in a cross section of the paddle. The same applies to a paddle which is formed from a bent metal sheet.

The back angle can be greater than or equal to 0°, preferably exactly 0°. Since the back angle is greater than or equal to 0°, the product to be mixed is substantially not conveyed backward but rather merely mixed in the event of backward turning of the mixer shaft. Here and hereinbelow, backward turning is understood to mean turning during which the paddle does not move in the direction of the cutting edge, but rather in the opposite direction. Correspondingly, by way of example during start-up of a mixer, the mixer shaft can initially be turned backward, such that the material which has been introduced into the mixer is merely mixed and, if appropriate, conditioned, but is not conveyed in a direction parallel to the mixer shaft. In the event of such backward turning of the mixer shaft, no dynamic pressure is generated in the entry region of the mixer, and the material to be mixed is correspondingly spared. Once the required mixing or conditioning has been achieved, the turning direction of the mixer shaft can be reversed, and the material to be mixed is mixed further and conveyed at the same time.

The sum total of working angle and back angle can be between 4° and 50°, preferably between 6° and 30°, particularly preferably between 7° and 15°. It has been found that such an angle between the working face and the back face represents an optimum both for conveying the product to be mixed and for mixing, in particular in the event of backward turning of the mixer shaft.

The paddle can have a cutting edge or a cutting face which, during intended use, extends proceeding from a region adjacent to the mixer shaft as far as a substantially outermost dimension of the paddle. In this case, a cutting edge is understood to mean that edge at which the working face and the back face intersect. Such a cutting edge does not necessarily have to have a sharp-edged configuration, but can also have a certain radius or be blunt, such that a cutting face is formed. It is similarly conceivable that the cutting edge, or if appropriate the cutting face, has a wider or narrower configuration in the region of the paddle which lies close to the mixer shaft than in the region of the outermost dimension of the paddle. Since the cutting edge or cutting face extends as far as the outermost dimension of the paddle, it is ensured that the paddle can be guided through the material to be mixed with the smallest exertion of force possible.

A mixing face can be located opposite the cutting edge, extending, during intended use, proceeding from a region adjacent to the mixer shaft as far as a substantially outermost dimension of the paddle. A mixing face of this type brings about optimum mixing of the material to be mixed, particularly in the event of backward turning of the mixer shaft. Although such a mixing face has increased resistance when passing through the material to be mixed in the event of backward turning of the mixer shaft, on the other hand it makes optimum mixing possible.

The cutting edge and/or the mixing face can be arranged in a substantially radial manner in relation to an axis of rotation of the mixer shaft during intended use. Such a radial orientation of the cutting edge and/or of the mixing face ensures that the working face has a wider configuration, in the outermost end of the paddle and accordingly displays a greater conveying action and/or mixing action.

The mixing face can include a mixing angle of between 40° and 86°, preferably of between 60° and 84°, particularly preferably of between 75° and 83°, with the back face. A mixing face of this type, which has a slight inclination with respect to an axis of rotation of a mixer shaft, reduces the resistance when the paddle is guided through the product to be mixed in the event of backward rotation of the mixer shaft.

The paddle can be formed from a square profile with a welded-on metal sheet bent so as to have a v-shaped cross section. The tip of the v-shaped metal sheet forms the cutting edge, whereas the mixing face is formed by a face of the square profile located opposite the cutting edge. Instead of the bent metal sheet, two sheet-metal plates can alternatively be interconnected at an angle to one another. It is advantageous in this respect that it is possible to use standard components.

Alternatively, the paddle can be embodied as a simple baffle plate, which, however, is mounted rotatably, such that the working angle and back angle are adjustable. The paddle can thus be oriented in such a manner, depending on the direction of rotation, that conveying and/or mixing is carried out.

As a further alternative, it is possible to form the paddle from a flexible material and to arrange it in such a manner that, during movement in the turning direction, the paddle is substantially rigid and brings about conveying, whereas, in the event of backward turning, the paddle is compliant and is deformed by the product to be mixed, and consequently brings about only mixing rather than conveying.

A mode of operation of this kind can also be achieved, in that, instead of the flexible material, the paddle is articulated on the mixer shaft in such a manner that, during movement in the turning direction, it is held in a working position by the product to be mixed and brings about conveying, whereas, during backward turning, the paddle is pivoted out of the working position by the product to be mixed and consequently brings about only mixing rather than conveying. The articulation can be provided radially, tangentially or in any desired orientation, with respect to the mixer shaft. Provision can also be made for there to be stop elements which delimit the pivoting movement of the paddle, the delimitation with further preference being adjustable.

By way of example, use can be made here of paddles made of a rubber-like material, which operate in the manner of a pastry scraper.

The paddle can also consist at least in certain regions of articulated or rotatably mounted elements in the manner of a Venetian blind, these being adjusted in terms of their position, depending on the direction of rotation, in order to bring about conveying or mixing.

To set the desired action in the direction of rotation, the paddle can furthermore at least partially have pneumatically or hydraulically operable regions, which make it possible to change the working angle and/or the back angle. The paddle can also be formed as a whole from an inflatable element.

The paddle can have an opening which is continuous from the working face to the back face. An opening of this nature through the working or back face allows the product to be mixed to flow through, and therefore optimum mixing takes place.

The paddle can alternatively be formed from two elongate elements, which are arranged radially on the mixer shaft and are connected to one another by an arched connecting element at their end which is remote from the shaft. The connecting element can simultaneously serve as a scraper.

As has already been described above with respect to the paddle, the opening can also be provided with rotatable and/or foldable elements, which clear the opening only given a specific direction of rotation (turning direction or backward turning).

The paddle can also be formed as a brush, i.e. from a plurality of bristles or bristle-like elements arranged preferably radially with respect to the mixer shaft.

A paddle rail according to the invention for a mixer comprises a paddle holder and one or more paddles as described above. A paddle rail of this type makes it possible for a plurality of paddies to be simultaneously easily mounted on a mixer shaft of a mixer.

The paddle holder can have receiving positions for receiving the fastening means of the paddles. Receiving positions of this type are, for example, simple bores, into which a correspondingly embodied, fastening means of the paddle can be inserted. By way of example, the paddies are welded in the paddle holder. Alternatively, it is also conceivable for the fastening to be ensured by means of a press fit or by means of a screwed connection.

The paddle rail can have a plurality of fastening means for fastening the paddle rail on a mixer shaft. By way of example, the paddle rail can be screwed onto the mixer shaft, in the case of such a fastening method, the fastening means would preferably be through-bores, through which the paddle rail can be fastened on the mixer shaft by means of a corresponding screw. Alternatively, it is also conceivable, however, for the paddle rail to be latched into corresponding latching hooks of the mixer shaft and to be secured merely using a securing means, for example in the form of a pin or a screw. Simple detachable fastening makes it possible, in particular, to rapidly interchange worn paddle rails or worn paddles. Moreover, different paddle rails can be used, and interchanged in a correspondingly rapid manner, depending on the product to be mixed.

The paddle holder is preferably formed as a profile of u-shaped cross section and is preferably dimensioned in such a manner that in each case two paddle holders can encompass the mixer shaft. For better transmission of the torque, the mixer shaft can be formed with a substantially square cross section. When connected to one another, the two paddle holders likewise form a substantially square profile arrangement having an inner space, the dimension of which corresponds substantially to the outer dimensions of the mixer shaft. Alternatively, the mixer shaft can be formed, for example, as a splined shaft. A frictional connection with the mixer shaft is similarly conceivable.

A respective scraper can be arranged on the working face or on the back face of the paddles for stripping a material to be mixed during intended, use from a housing wall of a mixer. It is possible to use different scrapers depending on the product to be mixed, and therefore it is possible for a spacing between the scraper and the housing wall of the mixer to be adapted individually.

The scraper can have the form of a ring segment. The ends of the scraper which are arranged in the direction of rotation during intended use can be provided in each case with a connecting means, with which the scraper of one paddle can be connected to the scraper of a paddle which follows and/or precedes it in the direction of rotation. Since the scrapers of the individual paddles can be connected to one another, the scrapers can correspondingly have a filigree configuration, without however losing the required stability.

Alternatively, the scrapers can be embodied as a separate component for retrofitting and in particular can have connecting means which simultaneously serve both for connecting the scrapers to the paddle and for connecting the scrapers to one another. This provides a more cost-effective alternative which can easily be retrofitted.

A mixer shaft according to the invention of a mixer has at least in an initial region of the mixer shaft, a plurality of paddies or a plurality of paddle rails as described above. Accordingly, such a mixer shaft is suitable for simultaneously conveying and mixing the product to be mixed in one turning direction, whereas the mixer shaft merely mixes the product to be mixed in the other turning direction.

The paddles arranged in succession in the direction of rotation during intended use can be connected to one another by means of scrapers. Scrapers of this type serve on the one hand for stripping a material adhering to the housing wall of the mixer, and on the other hand the scrapers increase the stability of the individual paddies and also of the scrapers among one another.

The scraper can alternatively be embodied as a wire cable, which is fastened or guided along the mixer shaft in corresponding receiving portions of the paddles. This, too, provides an easier and more favorable variant for forming a scraper.

The pitch of the helical structure formed by the interconnected scrapers can be chosen depending on requirements. It is thus conceivable, for example, that not every paddle arranged in the direction of rotation is connected by means of scrapers to the following or preceding paddle, thus giving rise to a greater pitch. Furthermore, the scrapers can be connected to one another in such a manner that a plurality of helical structures are formed.

It is also possible for the helical structure to have a turning direction which is opposed to the turning direction of the paddles. This means that paddles arranged in the direction of rotation are arranged, for example, along an imaginary helix turning to the right, whereas the helical structure turns to the left.

The paddles or the paddle rails can be arranged exclusively in the initial region of the mixer shaft. A mixer shaft of this type is accordingly equipped with different conveying and mixing means. Since the correspondingly shaped paddies are arranged merely in the initial region, various mixing and conveying operations can be realized with the same mixer shaft. In particular, it is furthermore possible, however, to keep the product to be mixed, during start-up of the mixer, in the initial region of the mixer shaft until the required mixing is ensured.

The paddles and the paddle rail can also be arranged as desired along the mixer shaft, however.

A mixer according to the invention has a mixer shaft as described above. A mixer of this type makes easy start-up possible, without the product required for starting up the mixer being disposed of or recycled.

In particular, essentially no conveying of the product is brought about in the region of the mixer in which the paddles are arranged, in particular an initial region of the mixer shaft, when the mixer shaft turns in the first direction of rotation. For the purposes of the present invention, "essentially no conveying" is understood to mean that the product lingers in the region in which the paddles are arranged, and if appropriate is circulated there. This does not preclude a situation, however, in which the product is conveyed back and forth within the region, for example in a direction parallel to the mixer shaft, without, however, the product being conveyed as a whole in the direction of an outlet of the mixer and out of the region in which the paddies are arranged when the mixer shaft turns in the first direction of rotation. In addition, other elements can be fitted on the mixer shaft in a portion of the mixer adjacent to this region, these elements either bringing about no conveying or bringing about backward conveying, this meaning conveying in the direction of the inlet of the mixer.

To improve the mixing and conditioning during start-up, the mixer can be arranged with a gradient. By way of example, this means that the mixer shaft is not arranged in a substantially horizontal manner, but instead is arranged with a slightly downward inclination. In this case, the initial region of the mixer shaft is arranged lower than an outlet region, and therefore gravity is used to hold the product to be mixed in the initial region of the mixer during start-up of the mixer. Conversely, an outlet region can be arranged lower than the initial region. Through backward turning of the mixer shaft, the product to be mixed is conveyed "upward" in the direction of the inlet, but falls back through the effect of gravity in the direction of the outlet. The inclination of the mixer is preferably adjustable, such that the mixer is oriented in a horizontal manner again after start-up, for example.

In addition, paddies or paddle-like elements can be arranged on the inner face of the shell of the mixer in order to further improve the mixing.

With further preference, back-up means can be arranged in the mixer and hold the product to be mixed in the initial region of the mixer shaft during start-up. One possible embodiment of the back-up means is a pneumatic diaphragm plate, which is arranged extensively on the inner face of the shell of the mixer and cam be inflated as required. It is also possible for a diaphragm plate to be realized in the manner of an iris diaphragm.

The back-up means can also be arranged on the mixer shaft, for example in the form of collapsible elements which can be opened and closed in the manner of an umbrella.

Suitable materials for the mixer, in addition to the conventional metal materials, are also generally carbon-fiber-reinforced and/or glass-fiber-reinforced plastics (CFRP and/or GFRP) and/or plastics and also ceramic materials.

A method according to the invention for mixing a product to be conditioned in a mixer as described above comprises the following steps:

- the mixer is filled with a product to be conditioned,
- the mixer shaft is rotated in a first direction of rotation, such that the paddies essentially do not convey the material in a direction parallel to the mixer shaft,
- the mixer shaft is rotated in a second direction of rotation, such that the paddies convey the material in a direction parallel to the mixer shaft.

As already described, such a method makes it possible, in particular during start-up of a mixer, that the material to be mixed is mixed and conditioned, and is conveyed to the outlet of the mixer only once the required mixing and conditioning have been achieved by the mixer.

The steps of rotation in a first direction of rotation and in a second direction of rotation can be repeated several times. By virtue of the repeated change in the direction of rotation, it is still possible to influence the mixing and conditioning even during operation of the mixer.

Preconditioning or prefixing can be carried out prior to the method according to the invention.

If movable paddles are used, the mixing region along the shaft can be varied by changing the orientation of the paddles. By way of example, the mixing region can be configured to be shorter or longer depending on the throughput.

A further alternative or additional possibility consists in (additionally) mixing and heating the product to be mixed with compressed air and/or steam when the mixer shaft is stationary or turning. In this case, the nozzles for introducing compressed air and/or steam can be arranged both on the inner face of the shell of the mixer and on the mixer shaft.

To improve the mixing, provision can be made of rotating nozzles, which are made to turn by the outflow of compressed air and/or steam.

Figure 1B:
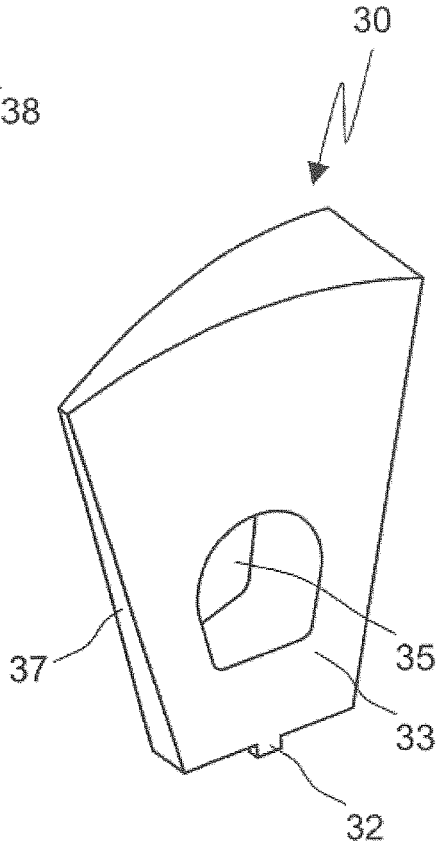
Figure 1C:
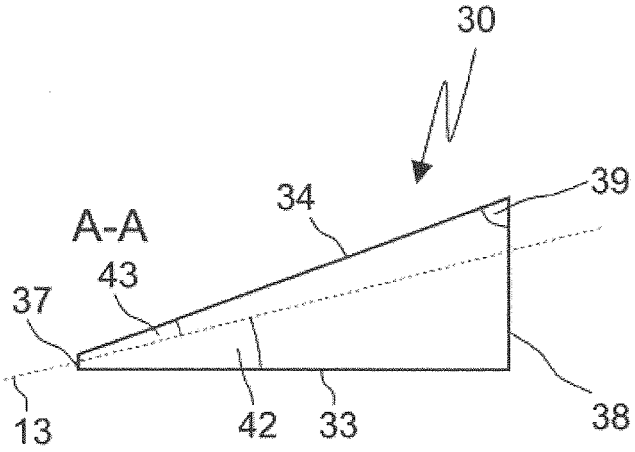
Figure 1D:
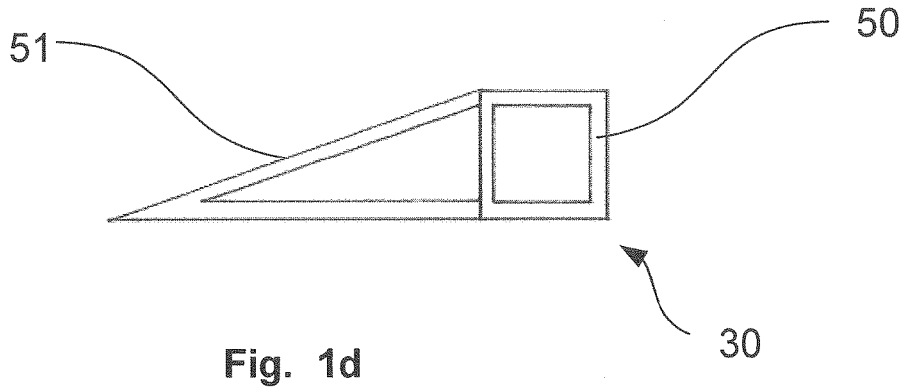
Figure 1E:
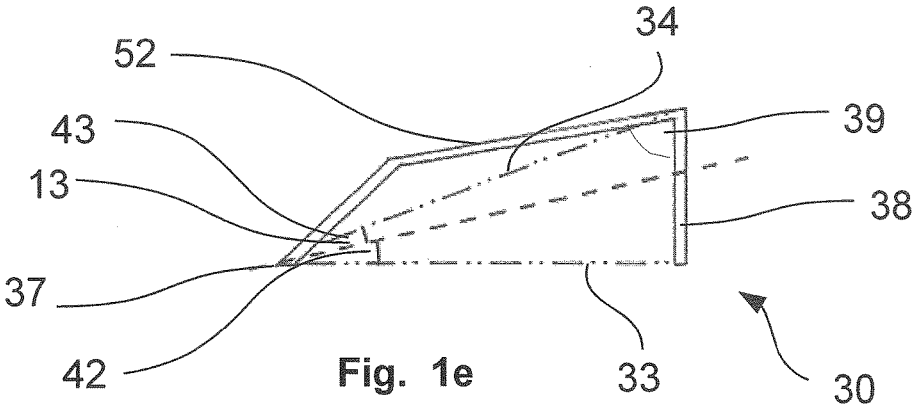
Figure 1J:
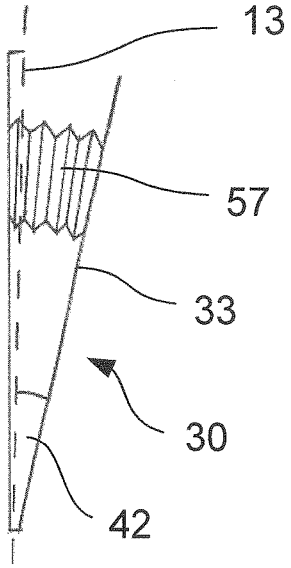
Figure 1F:
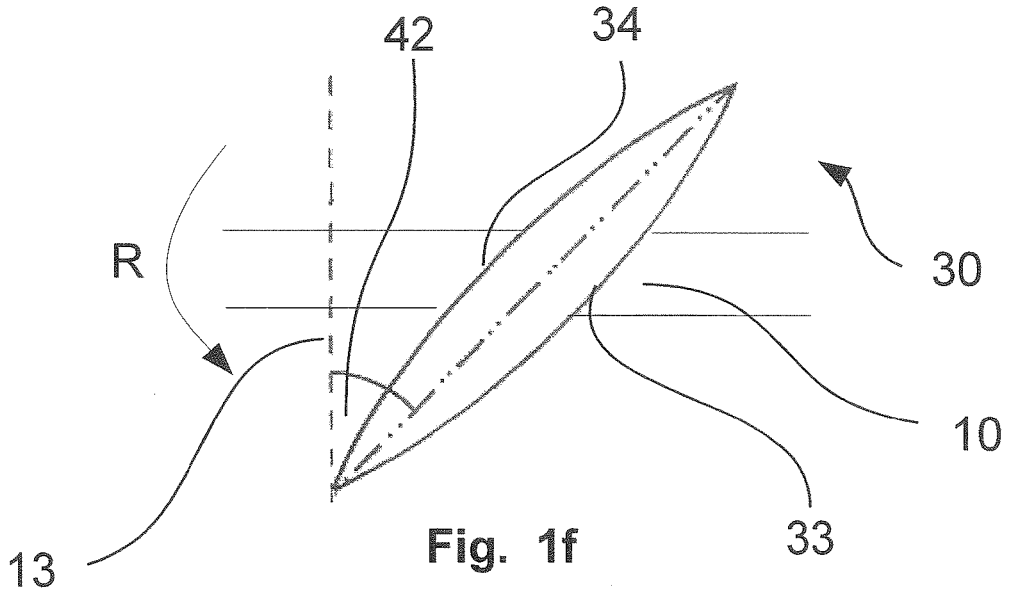
Figure 1G:
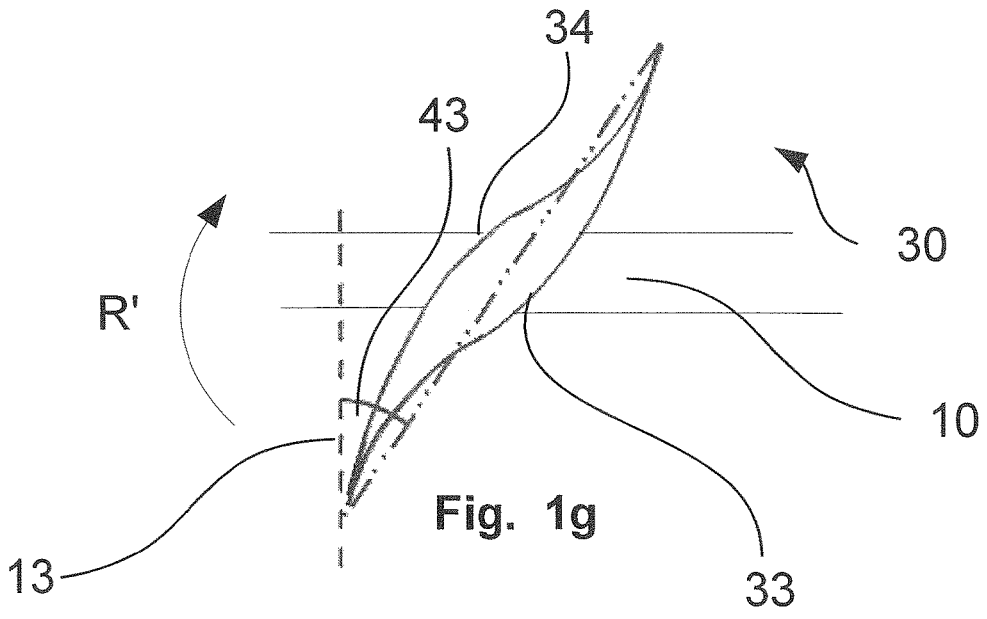
Figure 1H:
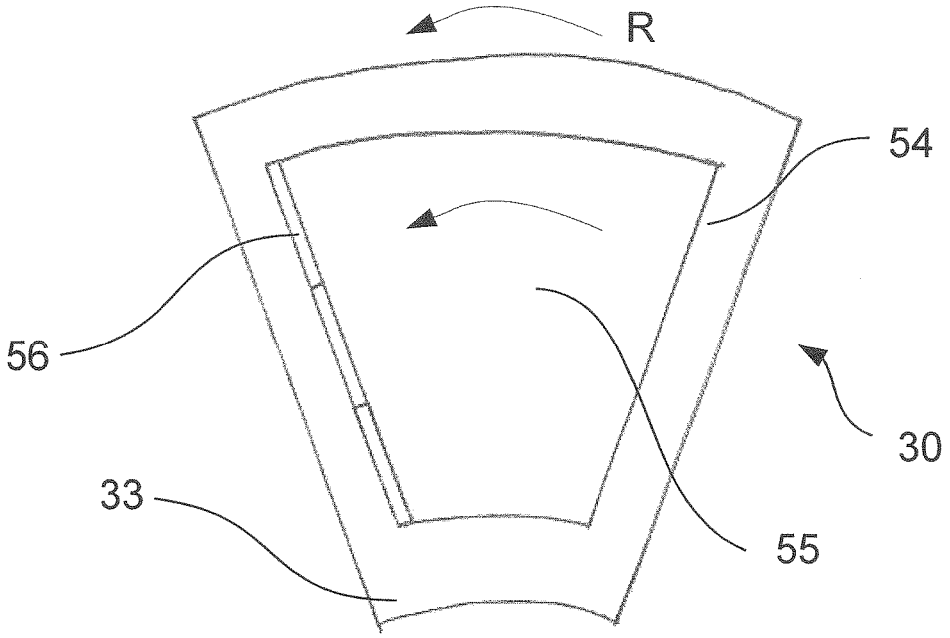
Figure 1I:
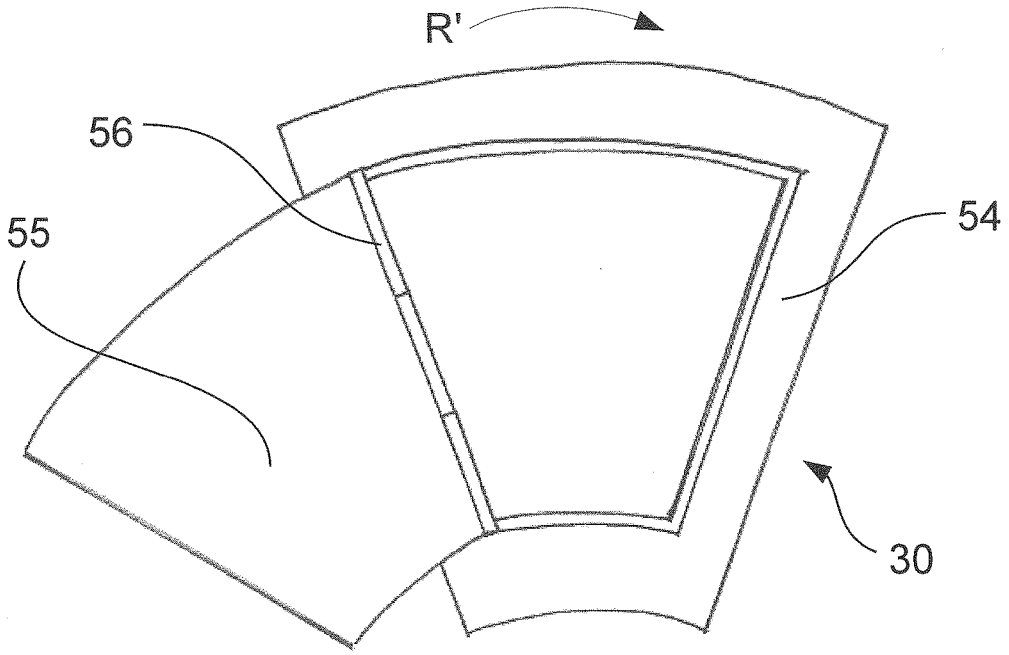
Figure 2A:
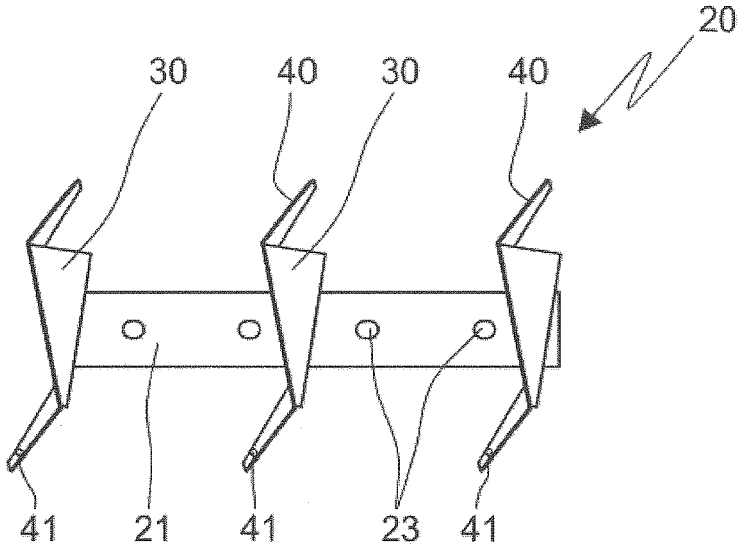

A further possibility for holding and mixing the material to be mixed in an initial region, of the mixer shaft consists in orienting the nozzles in such a manner that a flow of compressed air and/or steam counter to the actual conveying direction is generated. The invention will be explained in more detail, hereinbelow with reference to FIGS. which merely show exemplary embodiments and in which:

FIG. 1*a*: shows a plan view of a paddle according to the invention,

FIG. 1*b*: shows a perspective view of the paddle as shown in FIG. 1*a*, FIG. 1*c*: shows a cross section through the paddle as shown in FIG. 1*a* along the line A-A, FIG. 1*d*: shows a cross section through a second embodiment of a paddle, FIG. 1*e*: shows a cross section through a third embodiment of a paddle, FIG. 1*f*: shows a schematic cross section through a fourth embodiment of a paddle in the case of rotation in the turning direction, FIG. 1*g*: shows a schematic cross section of the paddle as shown in FIG. 1*f* in the case of backward turning, FIG. 1*h*: shows a schematic perspective view of a fifth embodiment of a paddle with a closed paddle flap, FIG. 1*i*: shows the paddle as shown in FIG. 1*h* with an open paddle flap, FIG. 1*j*: shows a cross section through a sixth embodiment of a paddle, FIG. 2*a*: shows a plain view of a paddle rail according to the invention.

Figure 2B:
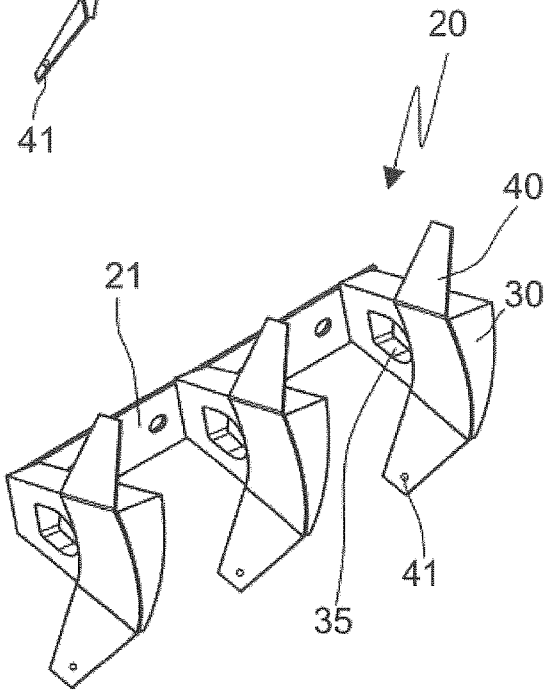
Figure 2C:
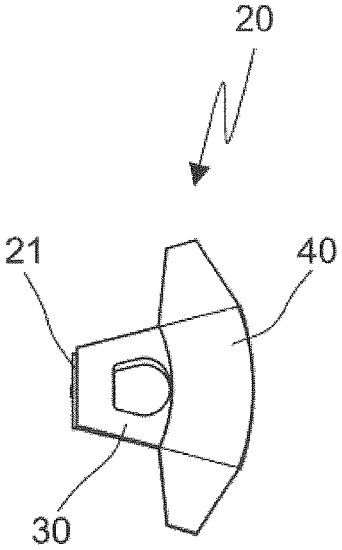
Figure 2D:
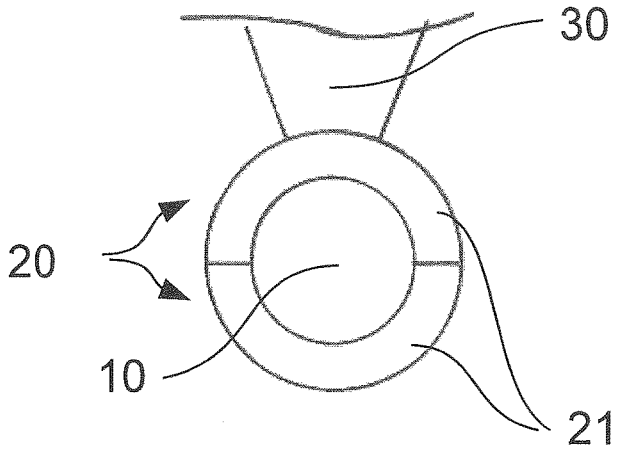
Figure 2E:
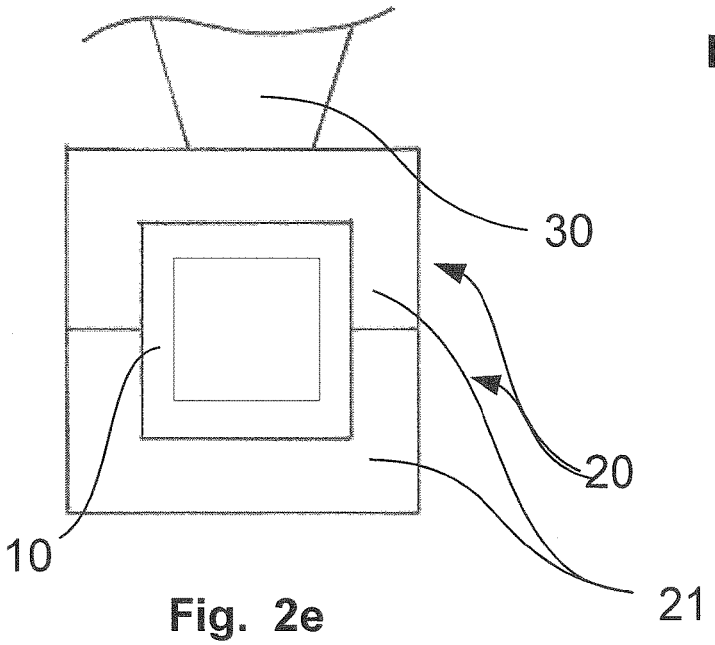
Figure 2F:
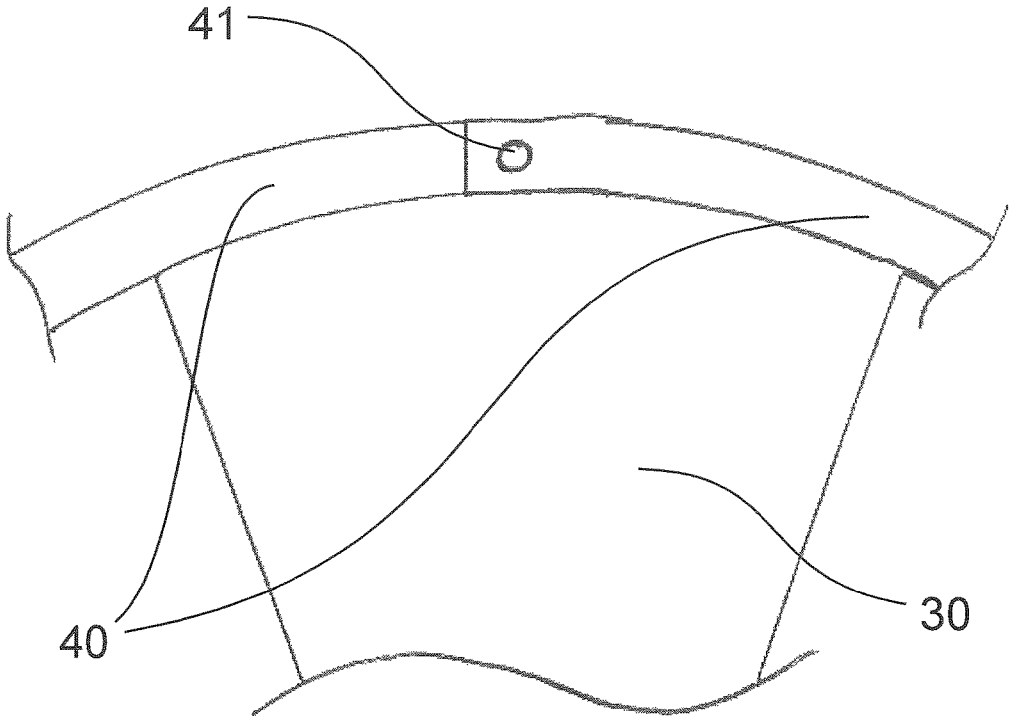
Figure 3A:
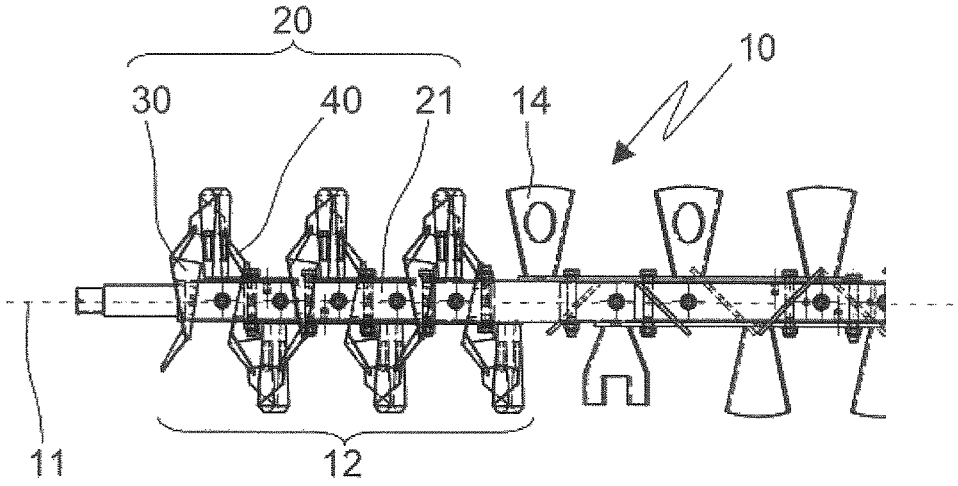
Figure 3B:
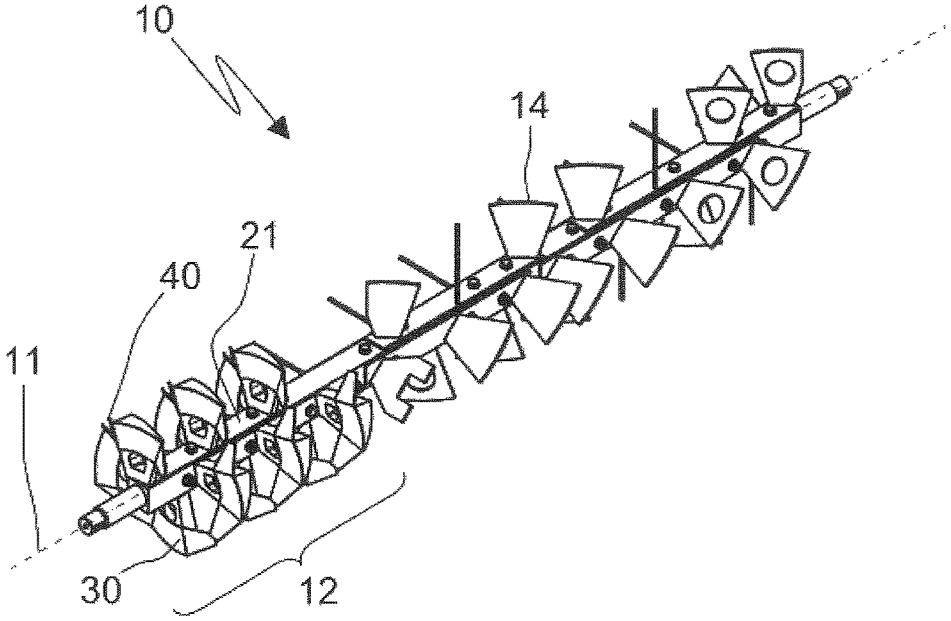
Figure 4A:
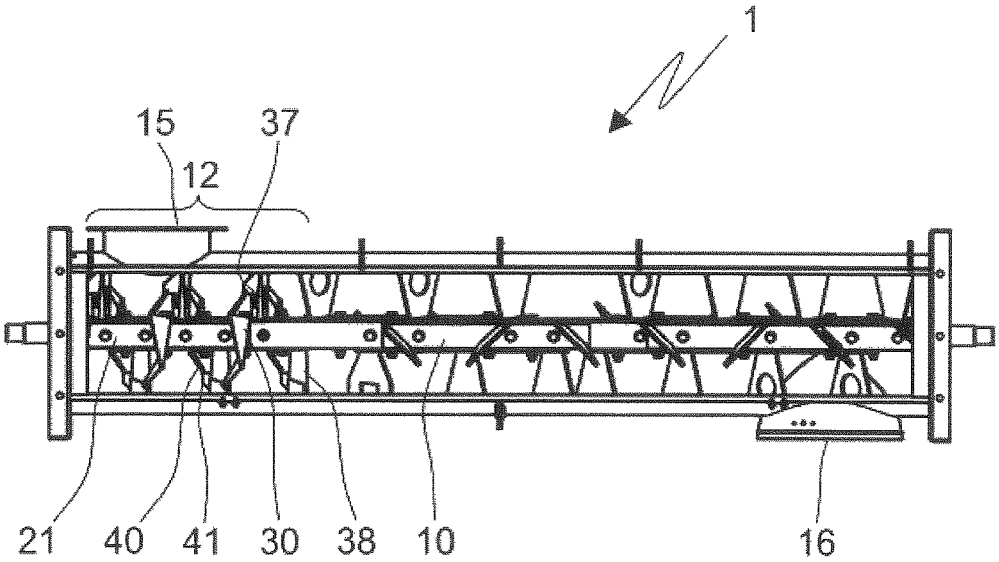
Figure 4B:
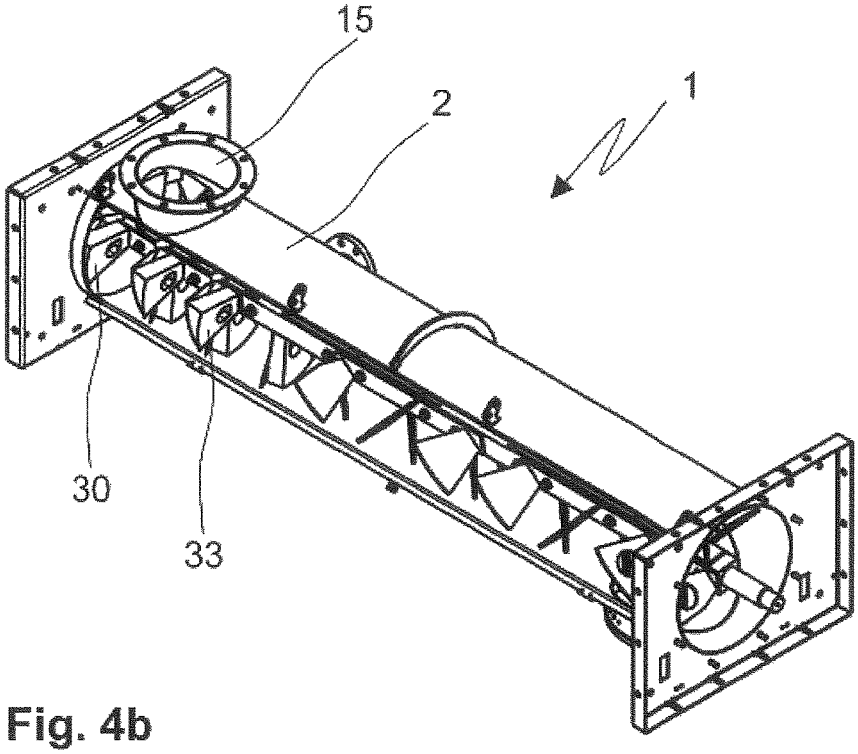

FIG. 2*b*: shows a perspective view of the paddle rail as shown in FIG. 2*a*, FIG. 2*c*: shows a side view of the paddle rail as shown in FIG. 2*a*, FIG. 2*d*: shows a schematic cross section of a farther embodiment of a paddle rail, FIG. 2*e*: shows a schematic cross section of a third embodiment of a paddle rail, FIG. 2*f*: shows a schematic side view of a paddle with scrapers fastened thereon, FIG. 3*a*: shows a plan view of a mixer shaft according to the invention, FIG. 3*b*: shows a perspective view of the mixer shaft as shown in FIG. 3*a*, FIG. 4*a*: shows a plan view of a mixer according to the invention, and FIG. 4*b*: shows a perspective view of the mixer as shown in FIG. 4*a*.

FIGS. 1*a* to 1*c* show a paddle 30 according to the invention. Here, FIG. 1*a* shows the paddle 30 in a plan view, FIG. 1*b* shows the paddle 30 in a perspective view and FIG. 1*c* shows the paddle 30 in a cross section along the line A-A as shown in FIG. 1*a*. The paddle 30 is essentially a planar element of wedge-shaped form.

On the leading side as considered in the direction of rotation R, the paddle 30 has a cutting edge 37, which is abraded to form a cutting face in the embodiment shown, however. This cutting edge 37 is formed as a line of intersection between the working face 33 and the back face 34, which are at an angle to one another.

A mixing face 38 is formed on the side located opposite the cutting edge 37, i.e. in the opposite direction of rotation R'.

The paddle 30 furthermore has a continuous opening 35 between the working face 33 and the back face 34. Moreover, on that side which is assigned to a mixing shaft during intended use, the paddle 30 has a fastening means 32 in the form of a stud. The side located opposite the fastening means 32 has a curved configuration, the curvature corresponding to a housing wall 2 (see FIG. 4*b*) of a mixer.

During intended use, the paddle 30 is arranged substantially on a plane 13 perpendicular to an axis of rotation of a mixer shaft. The back face 34 is, however, inclined in relation to this perpendicular plane 13 and includes a back angle 43 with the plane thereof. The working face 33 is likewise inclined with respect to the perpendicular plane 13 and includes a working angle 42. In this respect, it is always the case, however, that the working angle 42 is greater than the back angle 43.

The cutting edge 37 does not have a sharp form, but instead has on average a radius of approximately 2 mm. This radius can be adapted depending on the planned use. Alternatively, instead of a radius, it is also possible for a sharp cutting edge 37 or a blunt cutting edge 37 with a cutting face to be formed. The mixing face 38 located opposite the cutting edge 37 protrudes at a mixing angle 39 from the back face 34.

It goes without saying that ail faces, namely the working face 33, the back face 34 and the mixing face 38, can also be formed as curved faces. The corresponding angles, the working angle 42, the back angle 43 and the mixing angle 39, are then to be defined by means of an imaginary straight line through the end points of the corresponding faces.

During intended use, both the cutting edge 37 and the mixing face 38 extend proceeding from a mixer shaft 10 (see FIGS. 3*a* and 3*b*) as far as the outermost dimension of the paddle 30. During intended use, this outer dimension of the paddle 30 extends substantially as far as an inner side of a housing wall 2 (see FIG. 4*b*). It goes without saying that in this case there is always a certain gap between the housing wall 2 and the paddle 30 in the order of magnitude of 1 mm to 10 mm.

FIG. 1*d* shows a possible configuration of the paddle 30, consisting of a square profile 50 with a metal sheet 51 of v-shaped cross section fastened thereon.

FIG. 1*e* shows a paddle 30 formed from a single bent metal sheet 52. In this case, the imaginary working face 33 and back face 34 are represented by the lines with dashes and two dots, which each extend from the corresponding edge of the mixing face 38 as far as the cutting edge. The rest of the component parts correspond to those shown in FIGS. 1*a* to 1*c*.

FIGS. 1*f* and 1*g* schematically show the mode of operation of a paddle 30 made from a flexible material. In the direction of rotation R of the mixer shaft 10, the working face 33, which is arranged at a working angle 42 in relation to the plane 13, is not compliant. In the direction of rotation R', however, the paddle 30 is deformed by the product to be mixed, such as to form a back face 34 with a back angle 43 which is smaller than the working angle 42 in relation to the plane 13.

FIGS. 1*h* and 1*i* show a paddle 30 consisting of a paddle frame 54, on which a paddle flap 55, which is part of the working face 33, is articulated by means of a hinge 56. The paddle frame 54 and the paddle flap 55 are arranged on a mixer shaft in such a manner that, in the direction of rotation R, the paddle flap 55 remains closed by virtue of the pressure generated by the product on the paddle flap 55. In the direction of rotation R', the product exerts a pressure on the back face (not visible) of the paddle 30 which causes the paddle flap 55 to be opened, such that the product is not conveyed. In addition, provision may be made of means for holding the paddle flap 55 in the closed position, e.g. magnets, which allow the paddle flap to be opened only above a settable pressure threshold value. Provision may also be made of means for closing the paddle flap 55, e.g. a spring, which assist in closing the paddle flap 55.

Alternatively, the entire paddle can be articulated on the mixer shaft and the movement thereof can be delimited by stop elements, the position of the stop elements preferably being adjustable.

FIG. 1*j* shows a paddle 30 in which the working angle can be adjusted by means of a pneumatic element 57. Alternatively, the back angle can be adjusted in a similar way. It is also conceivable for both the working angle 42 and the back angle 43 or the orientation of the paddle 30 to be adjustable.

FIGS. 2*a* to 2*c* show a paddle rail 20 according to the invention. FIG. 2*a* shows a plan view, FIG. 2*b* shows a perspective view and FIG. 2*c* shows a side view of the paddle rail 20. The paddle rail 20 comprises a paddle holder 21, on which, in the exemplary embodiment shown, there are arranged three wedge-shaped paddles 30, as described above in relation to FIGS. 1*a* to 1*c*. The paddle holder 21 has four fastening means 23, which are configured as bores and by means of which the paddle rail 20 can be fastened, for example, on a mixer shaft 10 (see FIG. 3*a*). A respective scraper 40 is arranged on each of the three paddies 30 and is embodied at both ends with a respective connecting means 41. The scraper 40 is in this case fitted on the paddle 30 on the back face 34 (see FIG. 1*c*). It goes without saying that the scrapers 40 can have different configurations, depending on the application. In particular, the scrapers 40 can also have different configurations at the ends thereof in the region of the connecting means 41. By way of example, they can also have a straight configuration and be bent by an angle of approximately 90° only in the end region. The paddles 30 are introduced with their fastening means 32 (see FIG. 1*a*) into corresponding receiving positions (not shown) of the paddle holder 21, where they are accordingly welded. In this respect, the paddles 30 are arranged in such a manner that, during intended use of the paddle rail 20, the paddies 30 are arranged with their back face 34 or with the scraper 40 on a plane perpendicular to the axis of rotation 11 of a mixer shaft 10 (see FIG. 3*a*). Each of the paddles 30 is provided with an opening 35, this running proceeding from the working face 33 to the back face 34 (see FIG. 1).

FIG. 2*d* schematically shows two paddle rails 20, each comprising a paddle holder 21 and a paddle 30. The paddle holders 21 are in each case formed with a substantially u-shaped cross section, are arranged around a mixer shaft 10 and are connected to one another. A frictional connection serves for transmitting the torque.

Alternatively, the mixer shaft 10 can be in the form of a square profile, as shown in FIG. 2*e*. The paddle holders 21 are formed with a corresponding cross section. In this case, the torque is transmitted by means of a form fit.

FIG. 2*f* shows a paddle 30 having two scrapers 40, which are connected to one another and to the paddle 30 by means of connecting means 41. In this way, only one connecting means 41 is required for fastening the scrapers 40 on the paddle 30.

FIGS. 3*a* and 3*b* show a plan view of a mixer shaft 10 according to the invention and, respectively, a perspective view of the mixer shaft 10. A plurality of paddles 30 (as described above) are arranged, on the mixer shaft 10. These paddles 30 are located in an initial region 12 of the mixer shaft 10. Yet further mixing paddles 14 of differing configurations are arranged adjacent to this initial region 12. The paddles 30 are respectively connected to one another with the corresponding scrapers 40. In addition, the individual paddles 30 are arranged on a respective paddle holder 21. The paddles 30, the scrapers 40 and the paddle holder 21 together form a paddle rail 20 which can be exchanged easily when required. During intended use, the mixer shaft 10 rotates about the axis of rotation 11.

FIGS. 4*a* and 4*b* show a mixer 1 according to the invention, FIG. 4*a* showing a plan view and FIG. 4*b* showing a perspective view of the mixer 1 with an open housing wall 2. The mixer 1 has an inlet 15 and an outlet 16. In an initial region 12 of the mixer 1, the mixer shaft 10 arranged inside the mixer 1 is provided with wedge-shaped paddles 30, as described above. These wedge-shaped paddies 30 ensure that the product introduced into the mixer 1 is mixed and conveyed in one direction of rotation R (see FIG. 1*a*), while the product is merely mixed upon rotation of the mixer shaft 10 in an opposite direction R'. The individual paddles 30 are in each case connected to one another via scrapers 40. In this case, the paddles 30 are each arranged on a paddle holder 21. The ends of the scrapers 40 are provided with connecting means 41, which allow for the connection to a subsequent scraper 40. It can also be seen in FIG. 4*a* that the wedge-shaped paddies 30 have a mixing face 38 on the side counter to the direction of rotation R (see FIG. 1*a*), while a cutting edge 37 is arranged on the other side.

A mixer 1 of this type can then be filled at least partially with a product to be mixed via the inlet 15 during start-up, for example. Then, the mixer shaft 10 can be rotated in such a manner that the mixing faces 38 of the paddies 30 mix the product to be mixed. Only when the product to be mixed has reached the desired consistency, for example by charging with steam and/or by heating, is it possible for the direction of rotation of the mixer shaft 10 to be changed, such that the individual paddles 30 mix the product to be mixed with the working face 33 thereof and at the same time convey said product in the direction of the outlet 16. If necessary, the direction of rotation of the mixer shaft 10 can be changed once again, if the product to be mixed and to be conditioned does not yet satisfy the necessary conditions.

The invention claimed is:

1. A conditioner having at least one mixer shaft, on which at least one paddle is arranged in an initial region of the mixer shaft, wherein the at least one paddle comprises a planar element which has a working face and a back face and is positioned, during intended use, substantially on a plane perpendicular to an axis of rotation of the mixer shaft, and has a fastener fastening the paddle on the mixer shaft, the working face being inclined by a working angle on one side and the back face being inclined by a back angle on the other side of the plane perpendicular to the axis of rotation of the mixer shaft, the back angle is smaller than the working angle, and has other elements arranged in a region neighboring the initial region of the mixer shaft, and the conditioner, the mixer shaft and the at least one paddle are embodied in such a manner that:

during rotation of the mixer shaft in a first direction of rotation, a product which is to be conditioned and which partially fills the conditioner, is essentially not conveyed by the paddle in a direction parallel to the mixer shaft, such that the product is kept in the initial region of the mixer shaft, and wherein the other elements either bring about no conveying of the product in a direction parallel to the mixer shaft or bring about backward conveying of the product; and during rotation of the mixer shaft in a second direction of rotation, the at least one paddle conveys the product in a direction parallel to the mixer shaft, whereby the product is conveyed, via the region neighboring the initial region of the mixer shaft, to an outlet of the conditioner.

2. A method for mixing a product to be conditioned in a conditioner as claimed in claim 1, said method comprising the following steps:

partially filling the conditioner with the product to be conditioned, rotating the mixer shaft of the conditioner in a first direction of rotation such that at least one paddle arranged on the mixer shaft in an initial region of the mixer shaft essentially does not convey the product in a direction parallel to the mixer shaft, such that the product is kept in the initial region of the mixer shaft, and in a region neighboring the initial region of the mixer shaft other elements are arranged, which other elements either bring about no conveying of the product in a direction parallel to the mixer shaft or bring about backward conveying of the product, the paddle comprises a planar element which has a working face and a back face and is positioned, during intended use, substantially on a plane perpendicular to an axis of rotation of the mixer shaft, and has a fastener fastening the paddle on the mixer shaft, the working face being inclined by a working angle on one side and the back face being inclined by a back angle on the other side of the plane perpendicular to the axis of rotation of the mixer shaft, and the back angle is smaller than the working angle, and rotating the mixer shaft in a second direction of rotation such that the at least one paddle conveys the material in a direction parallel to the mixer shaft, whereby the product is conveyed via the region neighboring the initial region of the mixer shaft to an outlet of the conditioner.

3. The method as claimed in claim 2, wherein the steps of rotation in the first direction of rotation and in the second direction of rotation are repeated several times.

4. The method as claimed in claim 2, wherein, before or during the step of rotation in the first direction of rotation, the product is mixed by at least one of compressed air or steam.

5. The conditioner as claimed in claim 1, wherein an inclination of the conditioner is adjustable.

6. The conditioner as claimed in claim 1, wherein a sum total of working angle and back angle is between 4° and 50°.

7. The conditioner as claimed in claim 1, wherein the paddle has a cutting edge or cutting face which, when used as intended, extends proceeding from a region adjacent to the mixer shaft as far as a substantially outermost dimension of the paddle, the cutting edge or the at least one of the cutting face or the mixing face is arranged in a substantially radial manner in relation to the mixer shaft during intended use.

8. The conditioner as claimed in claim 7, wherein the mixing face includes a mixing angle of between 40° and 86° with the back face.

9. The conditioner as claimed in claim 1, wherein a paddle rail comprises a paddle holder and one or more paddles, the paddle rail is mounted on the mixing shaft, and the one or more paddles, comprised by the paddle rail, are arranged on the mixer shaft.

10. The conditioner as claimed in claim 9, further comprising a plurality of scrapers for stripping the product, which is intended to be conditioned, from a housing wall of the conditioner, and the scrapers are respectively arranged on the working face or the back face of each paddle.

11. The conditioner as claimed in claim 10, wherein the ends of each of the scrapers are provided with respective connectors which connect the scraper of one paddle to the scraper of a paddle which rotational follows or precedes the scraper, when used as intended.

12. The conditioner as claimed in claim 1, wherein at least one of the working angle or the back angle of at least one of the paddles, arranged on the mixer shaft, is variable.

* * * * *